United States Patent [19]

Chatelain et al.

[11] 3,952,076

[45] Apr. 20, 1976

[54] CARBURETTORS

[75] Inventors: Lucien Chatelain, Alfortville; Jean-Yves Lemonnier, Fontenay-le-Viconte, both of France

[73] Assignee: Regie Nationale des Usines Renault, France

[22] Filed: Mar. 18, 1975

[21] Appl. No.: 559,415

[30] Foreign Application Priority Data

Mar. 21, 1974 France ..... 74.09730

[52] U.S. Cl. ..... 261/41 D; 261/69 R; 261/DIG. 19; 261/DIG. 38; 123/97 B; 137/114; 137/625.3

[51] Int. Cl.[2] ..... F02M 3/04

[58] Field of Search ..... 261/DIG. 19, DIG. 38, 261/41 D, 69 R; 123/97 B; 137/114, 625.3

[56] References Cited

UNITED STATES PATENTS

| | | | |
|---|---|---|---|
| 2,214,964 | 9/1940 | Leibing | 261/DIG. 19 |
| 2,359,925 | 10/1944 | Leibing | 261/DIG. 19 |
| 2,711,883 | 6/1955 | Reeves | 261/DIG. 38 |
| 2,962,269 | 11/1960 | Stanton | 261/DIG. 19 |
| 3,330,544 | 7/1967 | Ozersky | 261/DIG. 19 |
| 3,455,260 | 7/1969 | Mennesson | 261/DIG. 19 |
| 3,590,793 | 7/1971 | Masaki | 261/41 D |
| 3,821,943 | 7/1974 | Toda et al. | 123/97 B |

FOREIGN PATENTS OR APPLICATIONS

| | | | |
|---|---|---|---|
| 1,337,410 | 4/1963 | France | 261/DIG. 19 |

*Primary Examiner*—Tim R. Miles
*Attorney, Agent, or Firm*—Bucknam and Archer

[57] ABSTRACT

A carburettor having a slow running jet with a device for controlling the output of the slow running jet during deceleration. The device comprises an axially movable closure member inside the jet, its axial movements being dependent upon the magnitude of depression downstream of the normal butterfly throttle. The closure member has passage means allowing fuel flow to pass from a fuel inlet into the slow running jet and its movements are controlled by a diaphragm acted upon at one side by atmospheric pressure and on the other side by the pressure prevailing in the downstream side of the carburettor or the induction manifold.

4 Claims, 1 Drawing Figure

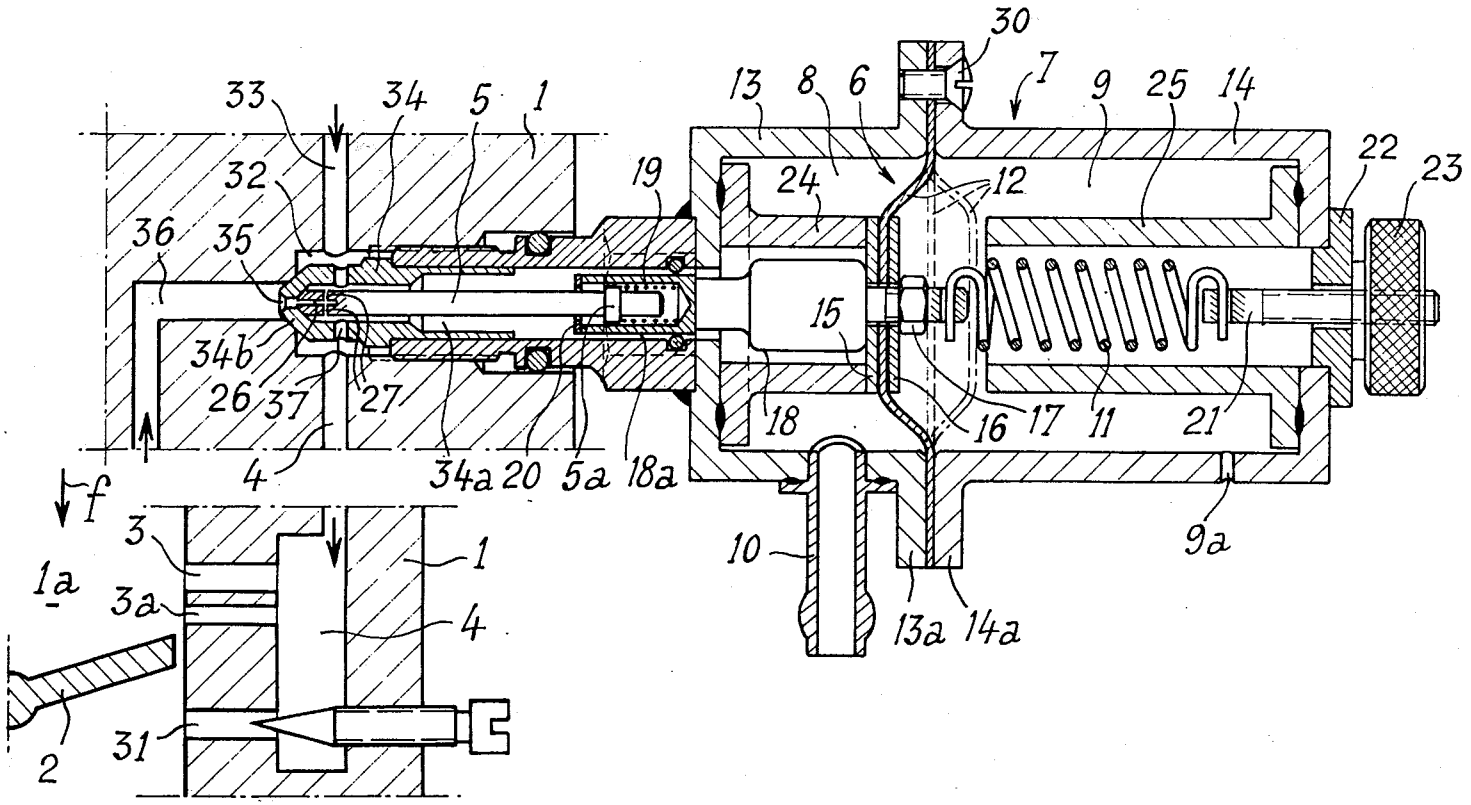
23
22
14
25
9
7
30
6
8
13
19
1
5
34
33
32
35
36
34b
26
37
4
27
34a
20
5a
18a
10
13a
14a
9a
21
11
17
16
12
15
18
24
f
1a
2
31
3a
3

CARBURETTORS

This invention relates to a carburettor having a slow-running jet whereof the output can be controlled, the carburettor comprising a main body in which a butterfly throttle is provided and opening into which, on the one hand, upstream of said butterfly throttle is a fuel supply circuit, a so-called "full load" circuit and, on the other hand, substantially in the region of the butterfly throttle, a so-called "slow running" circuit by means of so-called "progression" pipes and by a slow running pipe, which are connected to a slow running tube, this main body opening on the downstream side into an induction manifold, at which point a number of induction pipes leave, each opening into the chamber of one cylinder of the engine.

More particuarly, the invention relates to the carburation of controlled ignition engines, i.e. engines provided with carburettors, during the deceleration stage which is responsible for the increased formation of pollutants such as hydrocarbons and for a useless consumption of fuel.

In certain known devices, providing the optimum richness of the air/fuel mixture at the time of deceleration is achieved by a supply of air such that, due to this method, there is no reduction in the supply of fuel and at times there is even an increase in this supply.

Furthermore, other devices are known, such as cut-off devices or stop valves, controlled electronically, which have an all or nothing effect on the slow running jet. The drawback of these devices is that they are expensive, in particular because they require the use of a device for detecting the speed of the vehicle (tachometer dynamo, electronic circuit connected to the ignition circuit etc . . .).

The invention remedies these drawbacks and in particular its object is to provide a control making it possible, without a supply of fuel or air, to produce the optimum richness of the fuel mixture during the deceleration phase, by a progressive regulation of the supply of fuel passing through the slow running jet.

This control is achieved according to the invention, due to the fact that, provided in the chamber of the slow running jet, to be axially movable relative to and coaxial to said slow running jet is a closure member which is associated with means for controlling its axial movement depending on the magnitude of the depression prevailing downstream of the butterfly throttle, such that the slow running jet is partially closed by the closure member as soon as the depression prevailing downstream of said butterfly throttle reaches a predetermined degree.

The particular advantage achieved is a low concentration of hydrocarbons produced during deceleration, whilst reducing the consumption of fuel during this deceleration phase and without producing, as in the above-mentioned all or nothing devices, operating faults in the vehicle at the time of re-starting the slow running circuit.

Furthermore, the control according to the invention may advantageously be used with a catalyst operating in a weak mixture. In this case the control of the invention facilitates the production of excess oxygen favouring the transformation of the remaining hydrocarbons by combustion.

An embodiment of the present invention will now be described by way of example, with reference to the accompanying drawing which is an axial section through a control device.

The drawing illustrates a mechanical device for controlling the output, during deceleration, of the slow running jet of a carburettor comprising a main body 1 defining a pipe 1*a* for induction of the mixture in the direction of arrow *f*, a butterfly throttle 2 being provided in the pipe 1*a* into which opens on the one hand, upstream of said butterfly throttle 2, a fuel supply circuit, i.e. a so-called full load circuit (not shown), and, on the other hand, substantially in the region of the butterfly throttle 2, a so-called slow running circuit by means of an arrangement of so-called progression pipes 3, 3*a* and by an outlet pipe 31, said pipes 3, 3*a* and 31 being supplied with a fuel emulsion through a passageway or tube 4 provided in the wall of the main body 1. At the downstream side, the main body 1 opens into an induction manifold (not shown) starting at which point, as is known, are a number of induction pipes (not shown) each opening into the chamber of one cylinder of the engine.

The slow running supply tube 4 opens at its upper end into an annular chamber 32, also opening into which is a slow running air pipe 33 connected to atmosphere. Located in the chamber 32 is a slow running jet 34 comprising, at its end, an orifice 35 connecting a fuel inlet pipe 36 to a chamber 34*a* of the jet, said chamber 34*a* being connected to the annular chamber 32 by ports 37.

According to the invention, provided in the chamber 34*a* of the slow running jet 34, and arranged coaxially with respect to said jet 34 is an axially movable closure member in the form of a needle 5 which is connected to means for controlling its axial movement depending on the magnitude of the depression prevailing downstream of the butterfly throttle 2, such that said slow running jet 34 is partially closed by the needle 5 as soon as the depression prevailing downstream of said butterfly throttle 2 reaches a predetermined degree.

The means for controlling the axial movement of the needle 5 are constituted by a movable diaphragm 6 sub-dividing, in a fluid-tight manner, the inside of a control chamber 7 of circular section, into two chambers 8 and 9, whereof the chamber 8 is connected by a union 10 and a pipe (not shown) either to the side of the induction pipe 1*a* located downstream of the butterfly throttle 2, or to the induction manifold, whereas the other chamber 9 is connected to atmosphere by an orifice 9*a*. The movable diaphragm 6 is kinematically connected to the axial movement of the needle 5 as will be explained hereafter and a calibration spring 11 is interposed between said movable diaphragm 6 and a wall of the control chamber 7.

In the embodiment illustrated, the movable diaphragm 6 is constituted by a flexible element 12 which is interposed at its periphery in the manner of a gasket between securing flanges 13*a* and 14*a*, secured together by means of screws 30, of two coaxial half-chambers 13 and 14 of the same section and which together form the control chamber 7. The diaphragm 12 is made rigid in a central region thereof by two small circular plates 15 and 16 coaxial with the chamber 7 and sandwiching therebetween the diaphragm 12, the plates 15 and 16 being clamped together by a bolt 17, whereof the head is constituted by a connecting rod 18 connecting said small plates 15 and 16 to the needle 5, which is advantageously coaxial with said plates 15 and 16 and said control chamber 7.

Advantageously, adjacent the needle 5, the connecting rod 18 terminates in a tubular part 18*a* which is open towards the needle 5 and in the bore of which a rear collar 5*a* of the needle 5 can slide with slight lateral clearance, a compression spring 19 being interposed between said collar 5*a* and the base of said bore, a washer forming an abutment 20 being fixed coaxially at the open side of the tubular part 18*a* to serve as an end-of-travel abutment and to prevent the collar 5*a* leaving the bore of the part 18*a*. The members 18*a*, 5*a*, 19 and 20 constitute a compressible resilient connection between the plates 15 and 16 and the needle 5.

At the chamber side 9, the plates 15 and 16 are fixed to one end of the traction spring 11 which is housed in said chamber 9 and whereof the other end is fixed in adjustable axial position to the end wall of the half-chamber 14 by means of a securing member constituted by a screw-threaded rod 21 for regulating the calibration of said spring 11. This rod 21 is fixed to said end of the spring 11 and is screwed in an axial tapping of the end wall 22 forming a closure for the half-chamber 14. An operating hand-wheel 23 is provided on the part of the rod 22 located outside the chamber 9 to control the calibration of the spring 11 externally.

Provided in each of the chambers 8 and 9 of the enclosure 7 is a flanged sleeve in the shape of a collar 24 and 25 respectively, each of which is fixed by welding of its flange to the end wall of the half-chamber 13, 14. The sleeves 24 and 25 are arranged coaxially with respect to said half-chambers and have an outer diameter substantially equal to that of the plates 15 and 16 and constitute end-of-travel abutments for said plates 15 and 16.

The needle 5 comprises a front end portion in the shape of a conical point 5*b*, whereof the angle at the apex is advantageously slightly less than that of the inner side of concave conical shape of the outer wall 34*b*, of the slow running jet 34, this wall 34*b* being provided at its centre with the orifice 35 for the inlet of fuel. The front end of the needle 5 is provided with an aperture opening out, on the one hand, at the front end face of the needle 5 and, on the other hand, on the lateral face of said needle 5 to allow the fuel coming from the pipe 36 to pass through the orifice 35 towards the chamber 34*a*, when the needle is in the closed position that is with its point 5*b* against the end wall 34*b* of the jet 34. This fuel passage is obtained by a channel 26 coaxial with the needle 5 and which opens out, on the one hand, in the front end face of said needle 5 and which is connected, on the other hand, to several radial channels 27 of the needle 5, opening into the chamber 34*a* through the lateral surface of said needle 5.

Thus, the needle 5 moves axially under the effect of a pilot depression caused by the union 10 in the chamber 8. The needle may thus regulate the output of the jet 34 according to the pressure prevailing in the chamber 8 and the calibration of the spring 11. At the time of considerable so-called "foot off" or deceleration depressions, the slow running jet 34 is thus partially closed by the needle 5 allowing fuel to flow solely through the openings 26, 27 in its point 5*b*.

The above-described device makes it possible to reduce the quantity of unburnt hydrocarbons and the consumption of fuel during "foot off the accelerator" periods and deceleration. This device also makes it possible to eliminate shortages of reserve due to failure of the slow running supply tube 4. The slight escape of carburized mixture left by the needle 5 also prevents drying of the induction pipe, which due to its reimpregnation with fuel on the occasion of accelerations, also contributes generally to the above-mentioned lack of reserve.

What is claimed is:

1. A carburettor for an internal combustion engine, the carburettor comprising a main body, a butterfly throttle housed in said body, a fuel supply (full load) circuit opening into the body upstream of the butterfly throttle, a slow running circuit opening into the body substantially in the vicinity of the butterfly throttle via progression pipes and a slow running pipe, a slow running tube communicating with the pipes and opening out at its upper part into an annular chamber, a slow running air pipe opening into the annular chamber, a slow running jet provided in said annular chamber and whereof its inner chamber is connected to a fuel inlet pipe and to the annular chamber, said main body opening out, on the downstream side, into an induction manifold, from which a number of induction pipes leave, each for connection to one cylinder of the engine, an axially movable closure member arranged coaxially within the chamber of the slow running jet for controlling the output thereof, means for controlling axial movement of the closure member depending on the magnitude of depression prevailing downstream of the butterfly throttle, the slow running jet being partially closed by the closure member as soon as the depression prevailing downstream of said butterfly throttle reaches a predetermined degree, the closure member having a front end provided with passage means opening, on the one hand, at the front end and lateral faces of said closure member to allow fuel to pass from a fuel inlet pipe towards the inner chamber of the slow running jet through a front orifice of said jet when said closure member is in closed position, and a movable diaphragm to which the closure member is connected and which subdivides in fluid-tight manner a control chamber into two chambers, whereof one is connected either to the downstream side of the carburettor or to the induction manifold, while the other is connected to atmosphere by an orifice.

2. A carburettor according to claim 1, in which the passage means of the closure member is defined by a channel coaxial with said closure member and opening, on the one hand, into the front end face of said closure member and connected, on the other hand, to at least one radial channel of said closure member opening into the inner chamber of the slow running jet through a lateral face of the closure member.

3. A carburettor according to claim 1 in which the diaphragm is flexible and is interposed at its periphery in the manner of a gasket, between flanges for securing together two coaxial half-chambers forming the control chamber, two rigid plates being connected to a central region of the diaphragm with the diaphragm therebetween, a connecting rod secured to the plates and connected to the closure member by a resilient connection and a traction spring secured at one end to the plates with its other end fixed, in adjustable axial position, to a wall of the adjacent half-chamber by means of a securing member.

4. A carburettor according to claim 3, in which the member for securing the other end of the traction spring is constituted by a screw-threaded rod for regulating the calibration of said spring, this screw-threaded rod being screwed into a tapping in the end wall of the adjacent half-chamber.

* * * * *